US009653027B2

(12) United States Patent
Hwang

(10) Patent No.: US 9,653,027 B2
(45) Date of Patent: May 16, 2017

(54) DISPLAY APPARATUS

(71) Applicant: Samsung Display Co., Ltd., Yongin, Gyeonggi-Do (KR)

(72) Inventor: Young-Soo Hwang, Suwon-si (KR)

(73) Assignee: Samsung Display Co., Ltd. (KR)

( * ) Notice: Subject to any disclaimer, the term of this patent is extended or adjusted under 35 U.S.C. 154(b) by 95 days.

(21) Appl. No.: 14/678,461

(22) Filed: Apr. 3, 2015

(65) Prior Publication Data

US 2016/0005360 A1 Jan. 7, 2016

(30) Foreign Application Priority Data

Jul. 1, 2014 (KR) ..... 10-2014-0081922

(51) Int. Cl.

| | |
|---|---|
| ***G09G 3/36*** | (2006.01) |
| ***G09G 3/34*** | (2006.01) |
| ***G09G 3/20*** | (2006.01) |

(52) U.S. Cl.

CPC ..... *G09G 3/342* (2013.01); *G09G 3/2092* (2013.01); *G09G 2320/0209* (2013.01); *G09G 2320/0233* (2013.01); *G09G 2320/0626* (2013.01); *G09G 2330/02* (2013.01); *G09G 2330/12* (2013.01)

(58) Field of Classification Search

CPC .. G09G 3/342; G09G 3/2092; G09G 2330/12; G09G 2320/0209; G09G 2330/02; G09G 2320/0626; G09G 2320/0233

See application file for complete search history.

(56) References Cited

U.S. PATENT DOCUMENTS

| | | | | |
|---|---|---|---|---|
| 7,256,802 | B2 | 8/2007 | Park et al. | |
| 8,502,934 | B2 | 8/2013 | Lee et al. | |
| 2007/0274093 | A1 | 11/2007 | Haim et al. | |
| 2011/0084956 | A1 | 4/2011 | Choi et al. | |
| 2013/0135552 | A1 | 5/2013 | Huang | |
| 2014/0049734 | A1* | 2/2014 | Erinjippurath ..... | G09G 3/3611 349/96 |
| 2014/0210697 | A1* | 7/2014 | Hussain ..... | G09G 5/10 345/84 |
| 2015/0268795 | A1* | 9/2015 | Kurasawa ..... | G06F 3/0418 345/174 |

FOREIGN PATENT DOCUMENTS

| | | | |
|---|---|---|---|
| KR | 10-2007-0031041 | A | 3/2007 |
| KR | 10-2008-0032757 | A | 4/2008 |
| KR | 10-2009-0073458 | A | 7/2009 |
| KR | 10-2011-0025537 | A | 3/2011 |
| KR | 10-1328906 | B1 | 11/2013 |

* cited by examiner

*Primary Examiner* — Adam R Giesy
(74) *Attorney, Agent, or Firm* — Innovation Counsel LLP

(57) ABSTRACT

According to an embodiment, a display apparatus includes a display panel displaying an image, a backlight circuit supplying a light to the display panel, a host connector connected to a host, a main control board controlling the display panel to display an image in response to an image signal and a control signal that are provided from the host through the host connector, and a backlight control board separately provided from the main control board and receiving a source voltage from the host through the host connector to drive the backlight circuit.

14 Claims, 10 Drawing Sheets

DISPLAY APPARATUS

This U.S. non-provisional patent application claims priority under 35 U.S.C. §119 of Korean Patent Application No. 10-2014-0081922, filed on Jul. 1, 2014, the contents of which are hereby incorporated by reference in its entirety.

BACKGROUND

The present disclosure relates to a display apparatus. More particularly, the present disclosure relates to a display apparatus having a backlight unit.

A flat-panel display device is widely used as a display device for electronic devices designed to be lightweight, slim, and power efficient. A flat-panel display often makes use of a liquid crystal display that controls an amount of light provided thereto from an exterior to display an image. That is, the liquid crystal display is usually not self-emissive and may require a separate light source, e.g., a backlight unit including a backlight lamp.

A light emitting diode (LED) may be used as the light source to supply light to liquid crystal display due to its advantages, such as low power consumption, environmental friendliness, slim design, etc. However, a backlight control integrated circuit may be needed to drive the LED.

Small-scale electronic devices, such as a tablet PC, a mobile phone, a personal digital assistant, etc., are sometimes designed to allow a host device, e.g., a central processing unit, a graphic process, etc., to directly control the backlight unit without employing the backlight control integrated circuit. When the host device directly controls the backlight unit, a feedback signal from the backlight unit is applied to the host device through a printed circuit board.

The printed circuit board includes integrated circuits, e.g., a timing controller, a source driver, a power supply, etc., a signal line used to transmit an image signal to a display panel, and a power supply line, which are arranged on the printed circuit board. In general, the feedback signal generated by the backlight unit is a high-current signal and thus exerts an influence on the signal line. As a result, the image display quality of the display panel is deteriorated.

SUMMARY

The present disclosure provides a display apparatus capable of transmitting a feedback signal from a backlight unit to a host device without deteriorating a display quality.

Embodiments of the present disclosure provide a display apparatus including a display panel displaying an image, a backlight circuit supplying a light to the display panel, a host connector connected to a host, a main control board controlling the display panel to display an image in response to an image signal and a control signal that are provided from the host through the host connector, and a backlight control board separately provided from the main control board and receiving a source voltage from the host through the host connector to drive the backlight circuit.

The display apparatus may further include a flexible printed circuit board that electrically connects the host connector to the main control board and the host connector to the backlight control board.

The flexible printed may circuit board include a first plurality of line parts that electrically connect the host connector and the main control board and a second plurality of line parts that electrically connect the host connector and the backlight control board.

The source voltage may include a first source voltage and a second source voltage having a voltage level different from a voltage level of the first source voltage.

The backlight control board may drive the backlight circuit at the first source voltage.

The backlight control board may apply the first source voltage to the backlight circuit through the second plurality of line parts and a feedback signal from the backlight circuit to the host through the second plurality of line parts and the connector.

The backlight control board may include a backlight control integrated circuit that receives the second source voltage, applies a third source voltage to the backlight circuit, and controls the third source voltage in response to the feedback signal from the backlight circuit.

The backlight control board may include a mounting area in which the backlight control integrated circuit is mounted, a first circuit applying the first source voltage or a boosted source voltage from the backlight control integrated circuit to the backlight circuit as a third source voltage, a second circuit applying a feedback signal from the backlight circuit to the backlight control integrated circuit, and a third circuit applying the feedback signal from the backlight circuit to the host.

The backlight control board may be a first type backlight control board that receives the first source voltage from the host or a second type backlight control board that receives the second source voltage from the host.

The backlight control board may be the second type backlight control board and a backlight control integrated circuit may be mounted on the mounting area of the second type backlight board.

The backlight control integrated circuit may receive the second source voltage from the host through the host connector and boost the second source voltage to output the third source voltage.

The first circuit in the second type backlight control board may include at least one resistor to apply the third source voltage from the backlight control integrated circuit to the backlight circuit.

The second circuit in the second type backlight control board may include at least one resistor to apply the feedback signal from the backlight circuit to the backlight control integrated circuit.

The first type backlight control board may or may not include the backlight control integrated circuit in the area.

The backlight control board may be the first type backlight control board and the first circuit in the first type backlight control board may include at least one resistor to apply the first source voltage from the host to the backlight circuit as the third source voltage.

The third circuit in the first type backlight control board may include at least one resistor to apply the feedback signal from the backlight circuit to the host.

According to the above, a display apparatus according to an exemplary embodiment applies the feedback signal to the host through the backlight control board separately provided from the main control board. Under such a configuration, deterioration of the image display quality of the display panel due to the high-current, feedback signal may be prevented or otherwise reduced. In addition, because the main control board does not require a separate signal line for transmitting the feedback signal under such a configuration, a margin in the design of the main control board may be achieved.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

It is understood that when an element or layer is referred to as being "on", "connected to" or "coupled to" another element or layer, it may be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It is understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below may be referred to as a second element, component, region, layer or section without departing from the teachings of the present system and method.

Spatially relative terms, such as "beneath", "below", "lower", "above", "upper" and the like, may be used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" encompasses both an orientation of above and below. If the device is otherwise oriented (rotated 90 degrees or at other orientations), the spatially relative descriptors used herein are to be interpreted accordingly.

The terminologies used herein for the purpose of describing particular embodiments are not intended to be limiting of the present disclosure. As used herein, the singular forms, "a", "an" and "the" are intended to include the plural forms as well, unless the context clearly indicates otherwise. It is further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present system and method are explained with reference to the accompanying drawings.

Figure 1:
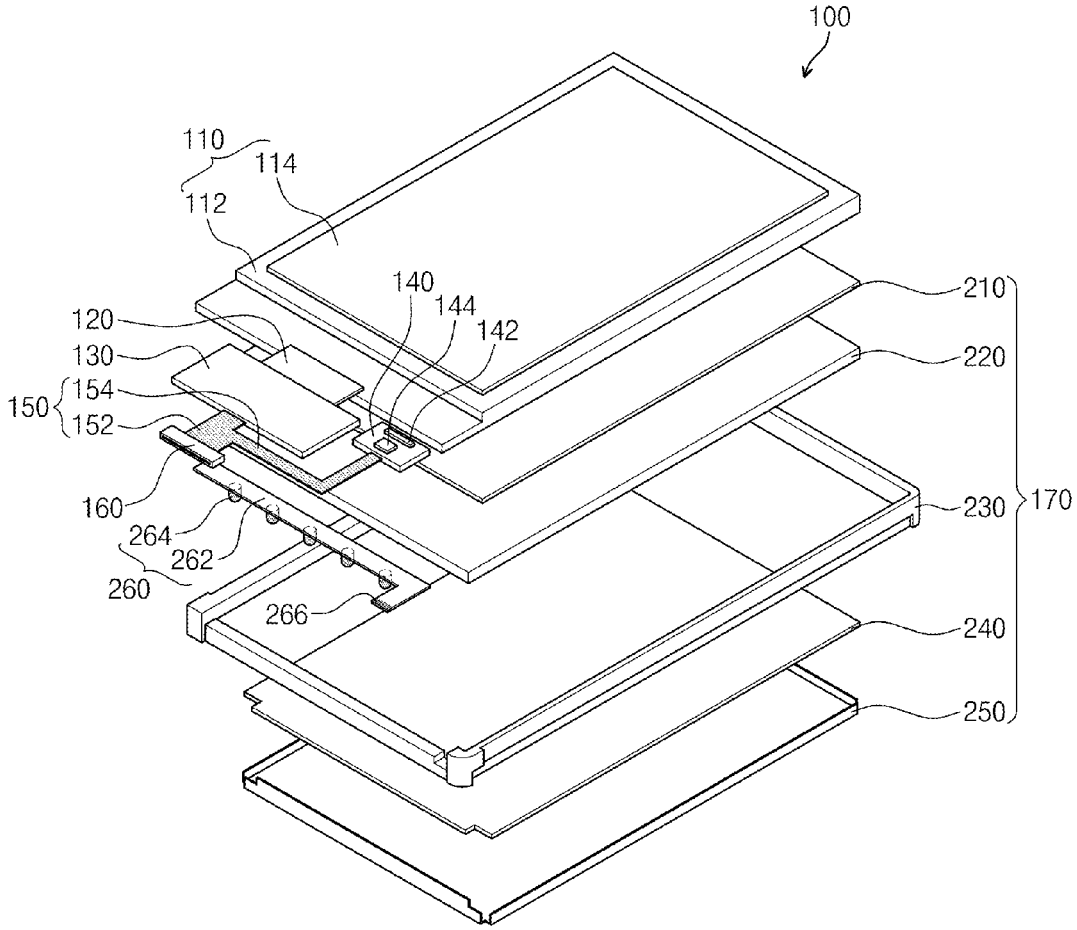
FIG. 1 is an exploded view showing a display apparatus, according to an exemplary embodiment of the present disclosure.
Figure 2:
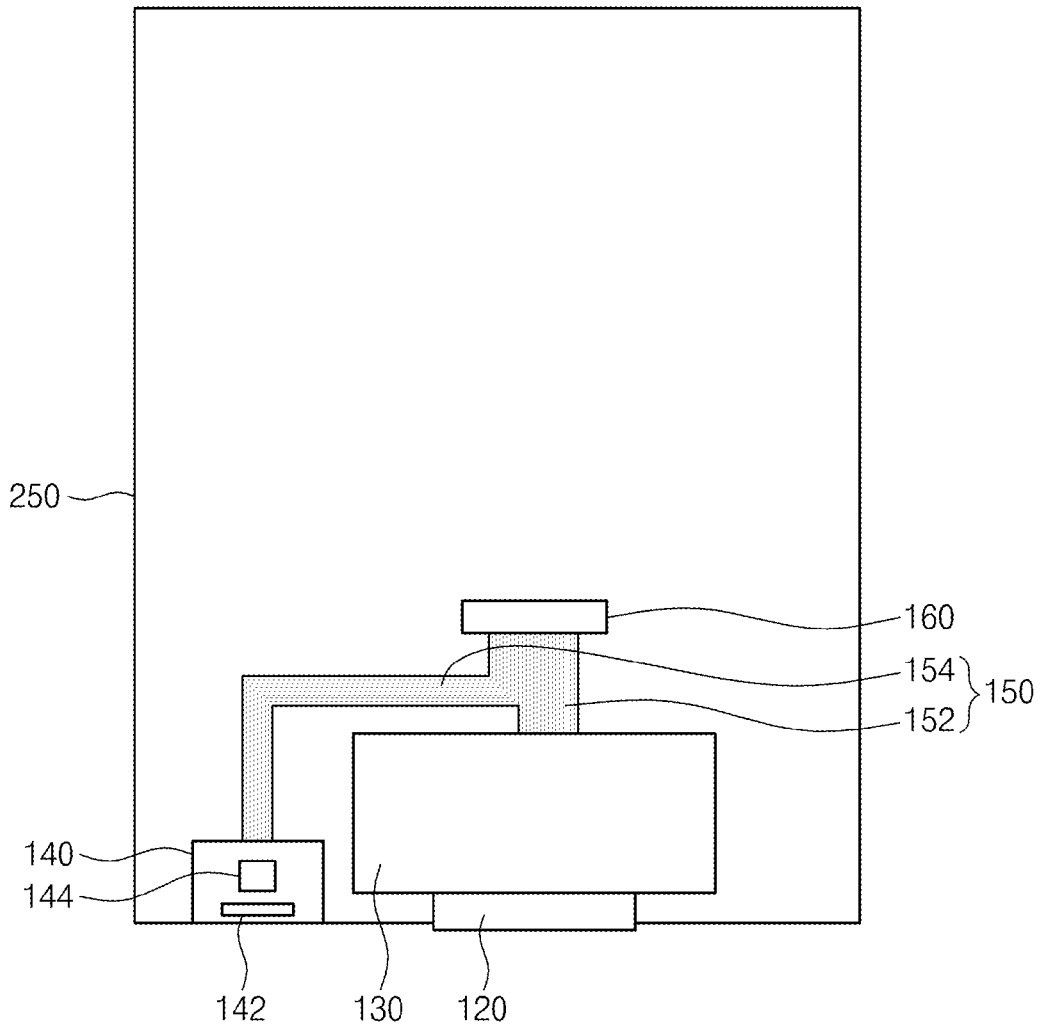
FIG. 2 is a plan view showing a rear surface of the display apparatus shown in FIG. 1, according to an exemplary embodiment.

FIG. 1 is an exploded view showing a display apparatus 100 according to an exemplary embodiment of the present disclosure. FIG. 2 is a plan view showing a rear surface of the display apparatus 100 shown in FIG. 1, according to an exemplary embodiment.

Referring to FIGS. 1 and 2, the display apparatus 100 includes a display panel 110, a first flexible printed circuit board 120, a main control board 130, a backlight control board 140, a second flexible printed circuit board 150, a connector 160, and a backlight assembly 170. A backlight assembly 170 includes an optical sheet 210, a light guide plate 220, a mold frame 230, a reflective sheet 240, a lower chassis 250, and a backlight unit 260.

The display panel 110 includes a lower display substrate 112, which includes gate lines, data lines, thin film transistors, and pixel electrodes, and an upper display substrate 114, which includes a black matrix and a common electrode, that is disposed to face the lower display substrate 112. According to another embodiment, the black matrix and the common electrode may be disposed on the lower display substrate 112. The display panel 110 receives light from the backlight unit 260 and displays an image. According to another embodiment, polarizing films (not shown) are respectively disposed on upper and lower surfaces of the display panel 110. In the exemplary embodiment of FIG. 1, the upper display substrate 114 has a size smaller than that of the lower display substrate 112.

When the thin film transistors are turned on, a number of electric fields are generated between the pixel electrodes and the common electrode. Due to the electric fields, an alignment of the liquid crystal molecules of a liquid crystal layer (not shown) disposed between the lower display substrate 112 and the upper display substrate 114, and thus a transmittance of the light passing through the pixels of the display panel 110, is varied. That is, by controlling the electric fields at the pixel level, the display panel 110 controls the transmittance of the light provided from the backlight assembly 170 so that a desired image is displayed on the display panel 110.

The mold frame 230 accommodates the display panel 110 and the optical sheet 210. The optical sheet 210 is disposed on the light guide plate 220 to diffuse and condense the light exiting through the light guide plate 220. The optical sheet 210 may include a first prism sheet, a second prism sheet, and a protective sheet. The first and second prism sheets refract the light exiting through the light guide plate 150 to condense the light incident thereto at a small angle in a frontal direction, thereby improving the brightness of the display apparatus 100 in an effective viewing angle range. The protective sheet disposed on the second prism sheet protects the second prism sheet and diffuses the light to allow uniform distribution of light. The configuration of the optical sheet 210, however, is not limited to that described above and may be changed depending on the specification of the display apparatus 100.

The light guide plate 220 is disposed adjacent to a plurality of light sources 264 to guide the light provided by the light sources 264. The light guide plate 220 diffuses the light from the light sources 264 in various directions to prevent non-uniformities of light (e.g., bright lines corresponding to the positions of the light sources 264) from occurring in the display apparatus 100. The light guide plate 220 includes a light incident part to which the light from the light sources 264 is incident and an opposite part facing the light incident part.

The reflective sheet 240 is disposed under the light guide plate 220 and reflects the light traveling downward from the light guide plate 220 toward the display panel 110. Thus, the reflective sheet 240 reduces light transmission losses and improves the uniformity of the light that is transmitted to the display panel 110. The reflective sheet 240 may be provided in the form of a separate sheet or a reflective pattern formed by coating a material having high reflectance on the lower chassis 250.

The backlight unit 260 includes a circuit board 262 and the light sources 264 mounted on one surface of the circuit board 262. The light sources 264 may include light emitting diodes. The light sources 264 are arranged in a predetermined direction and spaced apart from each other at regular intervals. The circuit board 262 on which the light sources 264 are mounted is disposed inside the lower chassis 250. The circuit board 262 may be, but not limited to, a flexible printed circuit board.

The main control board 130 is electrically connected to the lower display substrate 112 of the display panel 110 through the first flexible printed circuit board 120. Although not shown in the figures, various integrated circuits, e.g., a timing controller, a data driver, a power supply, etc., may be mounted on the main control board 130 to control the display panel 110 to display the desired image.

The backlight control board 140 includes a connector 142. The connector 142 is electrically connected to an end of the circuit board 262. The backlight control board 140 includes a backlight control IC (integrated circuit) 144 mounted thereon and supplies power to drive the light sources 264. In some cases, the backlight control IC 144 may be omitted from the backlight control board 140.

The main control board 130 and the backlight control board 140 are electrically connected to a connector 160 via the second flexible printed circuit board 150. The connector 160 is connected to a host device (not shown), e.g., a central processing unit, a graphic process, etc. The connector 160 may be attached to a rear surface of the lower chassis 250 when the first flexible printed circuit board 120 is bent.

The second flexible printed circuit board 150 includes a first plurality of lines 152 that electrically connect the connector 160 and the main control board 130 and a second plurality of lines 154 that electrically connect the connector 160 and the backlight control board 140. That is, although both the first plurality of lines 152 and the second plurality of lines 154 extend from the connector 160, the first plurality of lines 152 are connected to the main control board 130, while the second plurality of lines 154 are connected to the backlight control board 140.

The first plurality of lines 152 may include signal lines that transmit an image signal used to display the image and a control signal. The second plurality of lines 154 may include a power supply line that transmits power to drive the light sources 264 and a feedback signal line that transmits a feedback signal from the light sources 264 to the host device. Generally, because the feedback signal from the light sources 264 is a high-current signal, the feedback signal would exert an influence (e.g., electromagnetic noise) on the signal lines that are in close proximity. In the present exemplary embodiment, however, because the feedback signal line is connected to the host device through the backlight control board 140 and the second flexible printed circuit board 150, which are separated from the main control board 130, any influence on the signals transmitted through the main control board 130 that would otherwise be caused by the feedback signal is prevented or significantly reduced.

Figure 3:
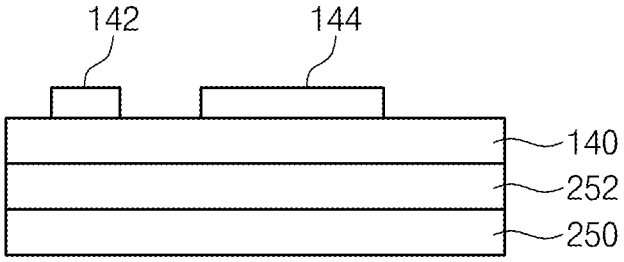
FIG. 3 is a cross-sectional view showing a backlight control board shown in FIG. 2, according to an exemplary embodiment.

FIG. 3 is a cross-sectional view showing the backlight control board shown in FIG. 2, according to an exemplary embodiment. Referring to FIG. 3, the display apparatus 100 shown in FIGS. 1 and 2 further includes a heat discharge gasket 252 disposed between the lower chassis 250 and the backlight control board 140. The connector 142 and the backlight control IC 144 are mounted on the backlight control board 140.

Figure 4:
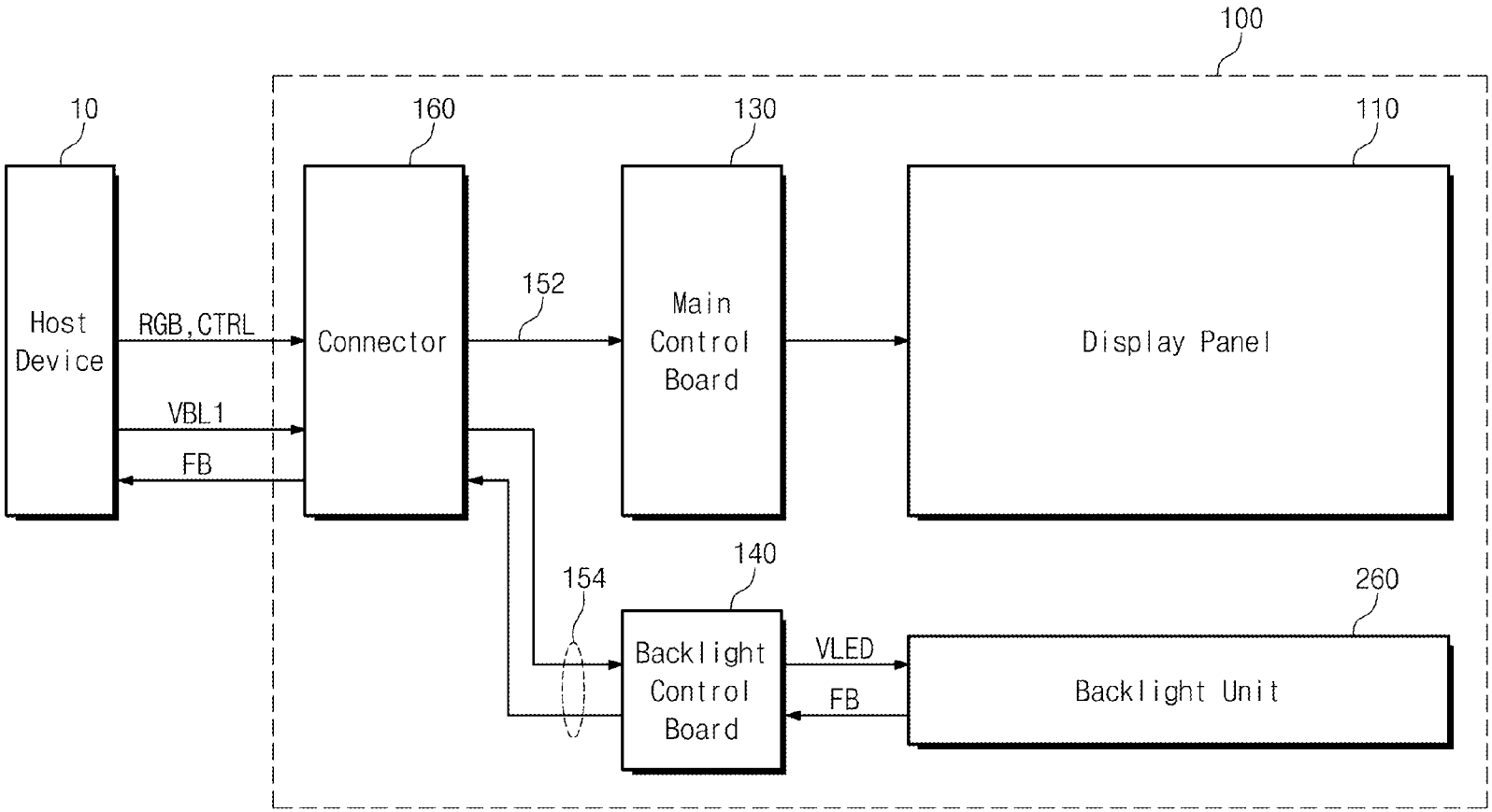
FIG. 4 is a block diagram showing the display apparatus shown in FIG. 1, according to an exemplary embodiment.

FIG. 4 is a block diagram showing the display apparatus shown in FIG. 1, according to an exemplary embodiment. Referring to FIG. 4, the display apparatus 100 includes the display panel 110, the main control board 130, the backlight control board 140, the backlight unit 260, and the connector 160.

The main control board 130 and the backlight control board 140 are connected to the host device 10 via the connector 160. In response to an image signal RGB and a control signal CTRL from the host device 10, the main control board 130 controls the display panel 110 to display an image that corresponds to the image signal RGB. The image signal RGB and the control signal CTRL provided from the host device 10 through the connector 160 are applied to the main control board 130 through the first plurality of lines 152.

The backlight control board 140 receives a first source voltage VBL1 from the host device 10 through the connector 160 and the second plurality of lines 154. The backlight control board 140 applies a third source voltage VLED to the backlight unit 260. In an exemplary embodiment, the third source voltage VLED is substantially equal to the first source voltage VBL1. The backlight control board 140 transmits a feedback signal FB from the backlight unit 260 to the host device 10 through the connector 160 and the second plurality of lines 154.

Figure 5:
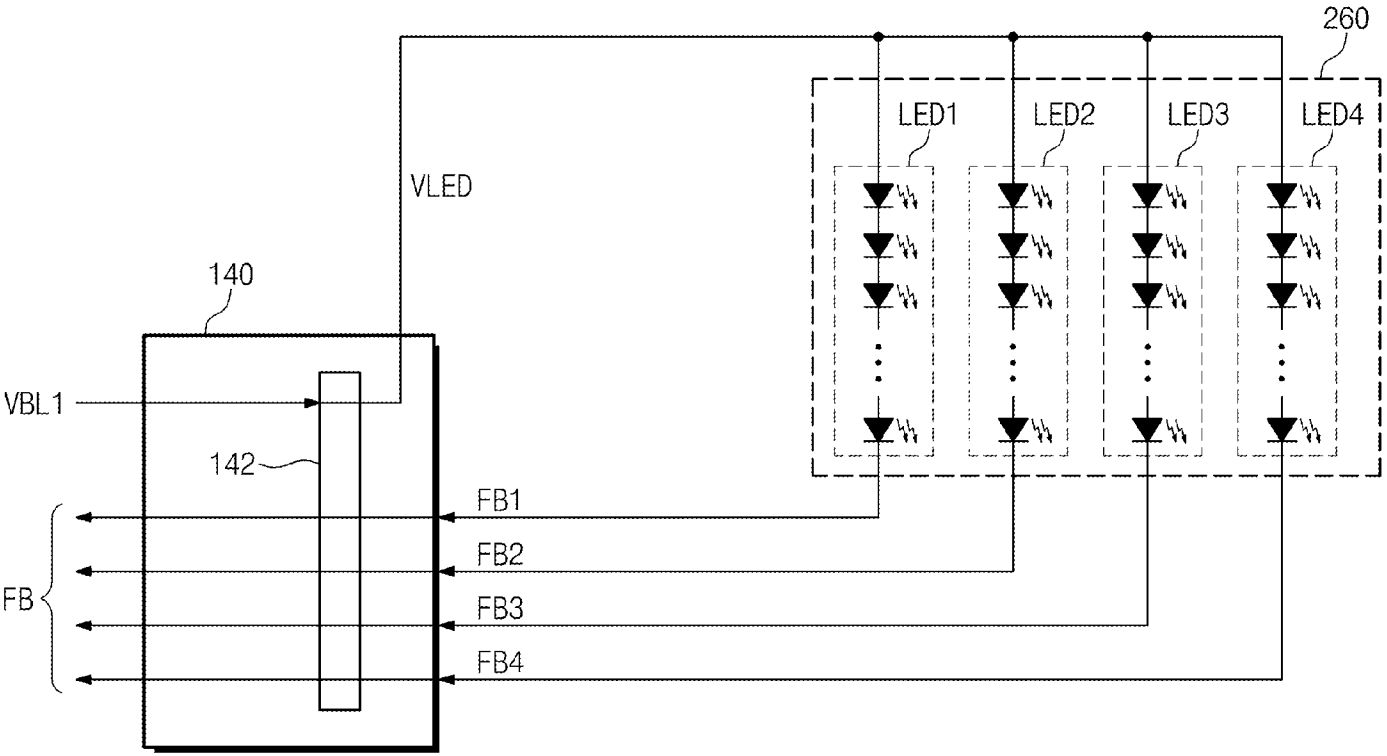
FIG. 5 is a circuit diagram showing a backlight control board and a backlight unit shown in FIG. 4, according to an exemplary embodiment.

FIG. 5 is a circuit diagram showing the backlight control board 140 and the backlight unit 260 shown in FIG. 4, according to an exemplary embodiment. Referring to FIG. 5, the backlight control board 140 includes the second plurality of lines 154 and the connector 142. The backlight unit 260 includes light emitting diode (LED) strings LED1 to LED4. Although the backlight unit 260 is shown to include four LED strings LED1 to LED4, the number of the LED strings is not limited to four and may be any number.

Each of the LED strings LED1 to LED4 includes a plurality of LEDs connected to each other in series. The LEDs may correspond to the light sources 264 shown in FIG. 1. Each of the LEDs may include a white LED emitting a white light, a red LED emitting a red light, a blue LED emitting a blue light, and/or a green LED emitting a green light. The white, red, blue, and green LEDs may have different light emitting characteristics and receive different forward driving voltages. To reduce power consumption in the LED strings LED1 to LED4, the LED strings LED1 to LED4 may include LEDs that are driven by a low forward driving voltage. In addition, to secure brightness uniformity, the LEDs may have small differences in their forward driving voltage. According to another embodiment, the backlight unit 260 may be configured to include a laser diode or a carbon nanotube instead of the LED strings LED1 to LED4.

An end of each of the LED strings LED1 to LED4 is connected to the third source voltage VLED from the backlight control board 140. Feedback signals FB1 to FB4 are respectively output from the other ends of the LED strings LED1 to LED4 and applied to the host device 10 (shown in FIG. 4) through the backlight control board 140. The feedback signals FB1 to FB4 may be current signals. The host device 10 (shown in FIG. 4) controls the voltage level of the first source voltage VBL1 in accordance with the feedback signals FB1 to FB4. In addition, the host device 10 may check the LED strings LED1 to LED4 for a malfunction and/or abnormal condition in response to the feedback signals FB1 to FB4. The feedback signals FB1 to FB4 are applied to the host device 10 through the backlight control board 140 and, thus, separately provided from the main control board 130 shown in FIG. 4. Providing the feedback signals FB1 to FB4 separately from the signals of the main control board 130 prevents the image displayed on the display panel 110 from being influenced by the high-current, feedback signals FB1 to FB4. In addition, because the main control board 110 is not tasked with transmitting the high-current, feedback signals FB1 to FB4, the design process of the main control board 110 becomes easier.

Figure 6:
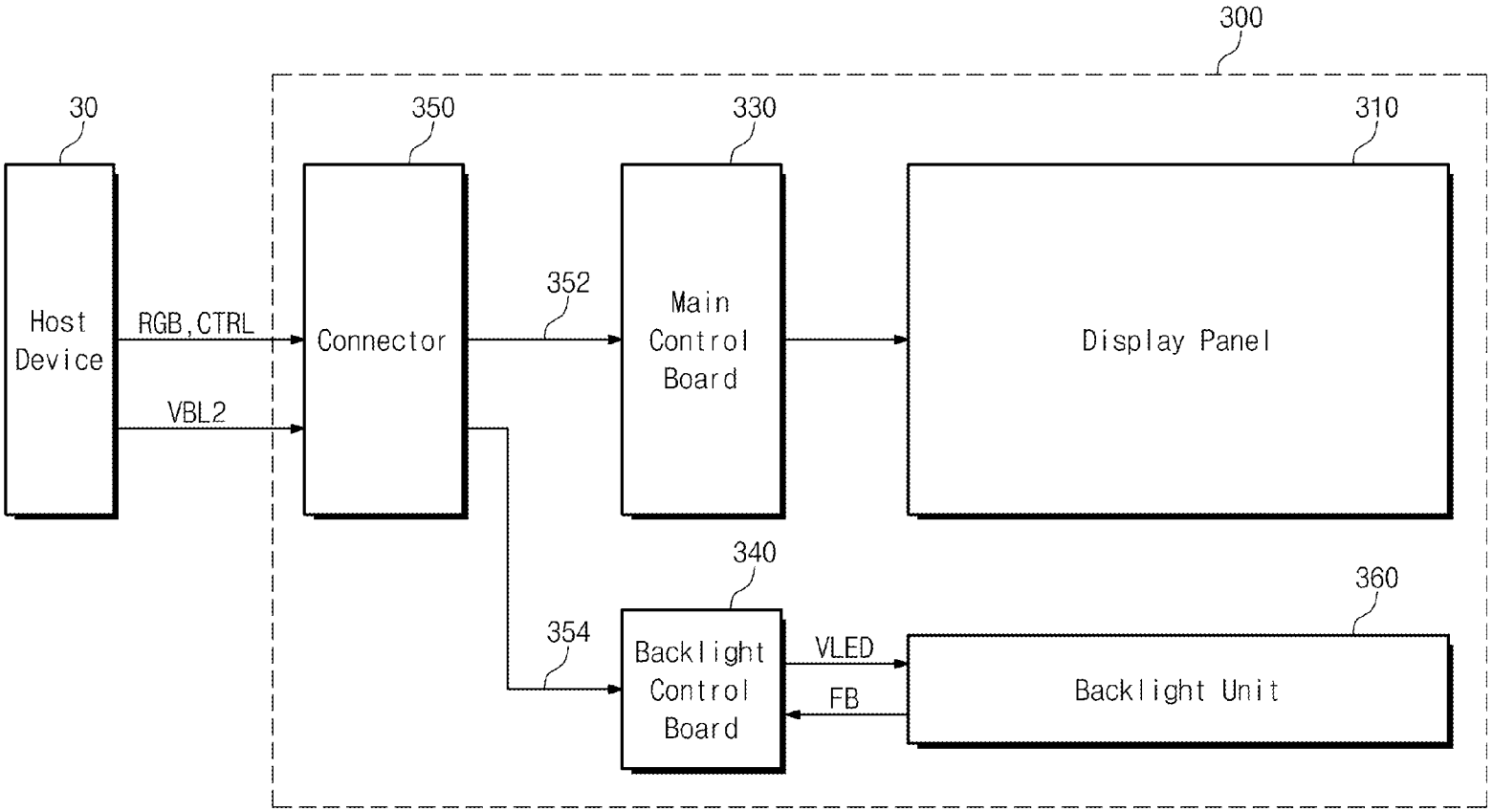
FIG. 6 is a block diagram showing a display apparatus according to another exemplary embodiment of the present disclosure.

FIG. 6 is a block diagram showing a display apparatus 300 according to another exemplary embodiment of the present disclosure. Referring to FIG. 6, the display apparatus 300 includes a display panel 310, a main control board 330, a backlight control board 340, a backlight unit 360, and a connector 350.

The main control board 330 and the backlight control board 340 are connected to a host device 30 via the connector 350. In response to an image signal RGB and a control signal CTRL from the host device 30, the main control board 330 controls the display panel 310 to display an image that corresponds to the image signal RGB. The image signal RGB and the control signal CTRL are provided from the host device 30 through the connector 350 and applied to the main control board 330 through a first plurality of lines 352.

The backlight control board 340 receives a second source voltage VBL2 from the host device 30 through the connector 350 and a second plurality of lines 354. The backlight control board 340 boosts the second source voltage VBL2 to the third source voltage VLED and applies the third source voltage VLED to the backlight unit 360. The backlight control board 340 controls the third source voltage VLED in response to a feedback signal FB from the backlight unit 360.

Figure 7:
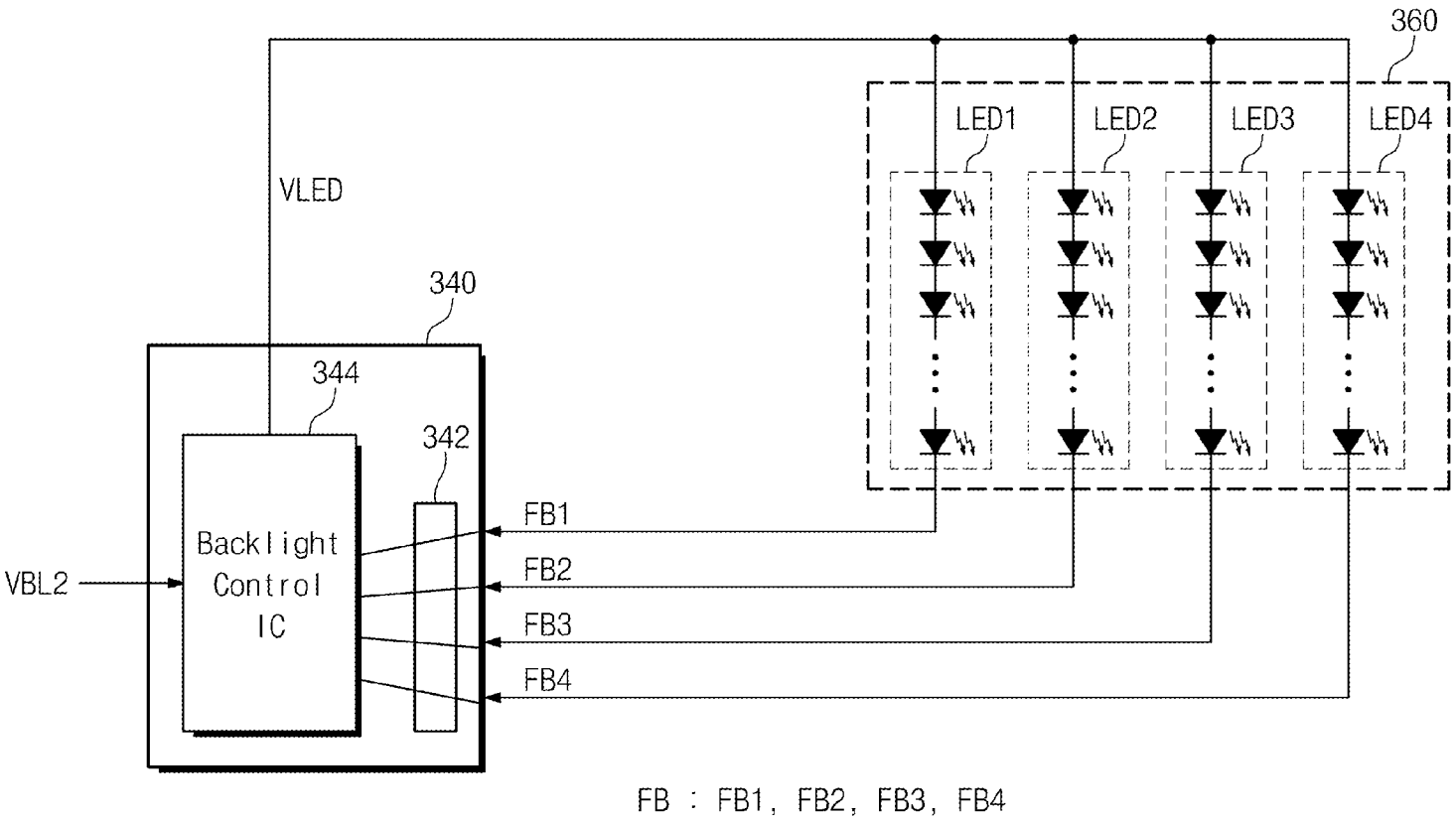
FIG. 7 is a circuit diagram showing a backlight control board and a backlight unit shown in FIG. 6, according to an exemplary embodiment.

FIG. 7 is a circuit diagram showing the backlight control board 340 and the backlight unit 360 shown in FIG. 6, according to an exemplary embodiment. Referring to FIG. 7, the backlight control board 340 includes a connector 342 and a backlight control IC 344. The backlight control IC 344 boosts the second source voltage VBL2 to output the third source voltage VLED. For example, when the second source voltage VBL2 is about 12 volts, the third source voltage VLED may be about 35 volts.

The backlight unit 360 includes LED strings LED1 to LED4. Although the backlight unit 360 of the present exemplary embodiment includes four LED strings LED1 to LED4, the number of the LED strings is not limited to four and may be any number. Each of the LED strings LED1 to LED4 includes a plurality of LEDs connected to each other in series.

An end of each of the LED strings LED1 to LED4 is connected to the third source voltage VLED from the backlight control IC 344. The feedback signals FB1 to FB4 are respectively output from the other ends of the LED strings LED1 to LED4 and applied to the backlight control IC 344 of the backlight control board 340. The backlight control IC 344 may sense a current level of the feedback signals FB1 to FB4 and control the voltage level of the third source voltage VLED in accordance with the sensed current level. In addition, the backlight control IC 344 may check the LED strings LED1 to LED4 for a malfunction and/or abnormal condition in response to the feedback signals FB1 to FB4.

Figure 8:
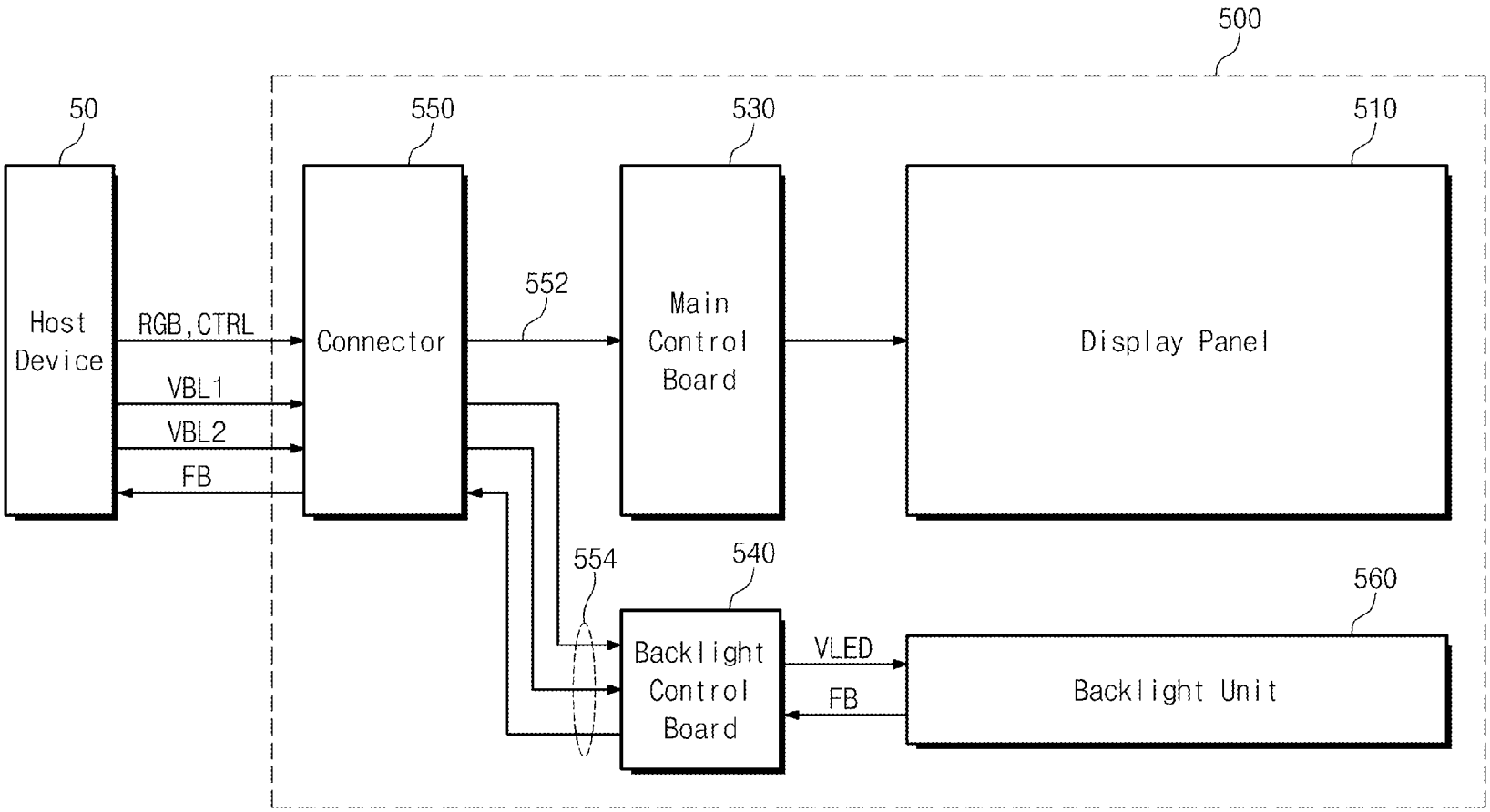
FIG. 8 is a block diagram showing a display apparatus according to another exemplary embodiment of the present disclosure.

FIG. 8 is a block diagram showing a display apparatus 500 according to another exemplary embodiment of the present disclosure. Referring to FIG. 8, the display apparatus 500 includes a display panel 510, a main control board 530, a backlight control board 540, a backlight unit 560, and a connector 550.

The main control board 530 and the backlight control board 540 are connected to a host device 50 via the connector 550. In response to an image signal RGB and a control signal CTRL from the host device 50, the main control board 530 controls the display panel 510 to display an image that corresponds to the image signal RGB. The image signal RGB and the control signal CTRL are provided from the host device 50 through the connector 550 and applied to the main control board 530 through first plurality of lines 552.

The backlight control board 540 may be realized by a first type backlight control board or a second type backlight control board. As used herein, the first type refers to a backlight control board that does not include a backlight control IC and receives the first source voltage VBL1 from the host device 50. The second type refers to a backlight control board that includes the backlight control IC and receives the second source voltage VBL2 from the host device. A second plurality of lines 554 includes source voltage lines that transmit the first and second source voltages VBL1 and VBL2. The backlight control board 540 receives the first source voltage VBL1 or the second source voltage VBL2 from the host device 50 through the connector 550 and the second plurality of lines 554.

The backlight control board 540 applies the third source voltage VLED to the backlight unit 560. The backlight control board 540 receives a feedback signal FB from the backlight unit 560. If the backlight control board 540 is the first type, it applies the feedback signal FB from the backlight unit 560 to the host device 50 through the second plurality of lines 554 and the connector 550. If the backlight control board 540 is the second type, it uses the backlight control IC to control the third source voltage VLED in response to the feedback signal FB.

Figure 9:
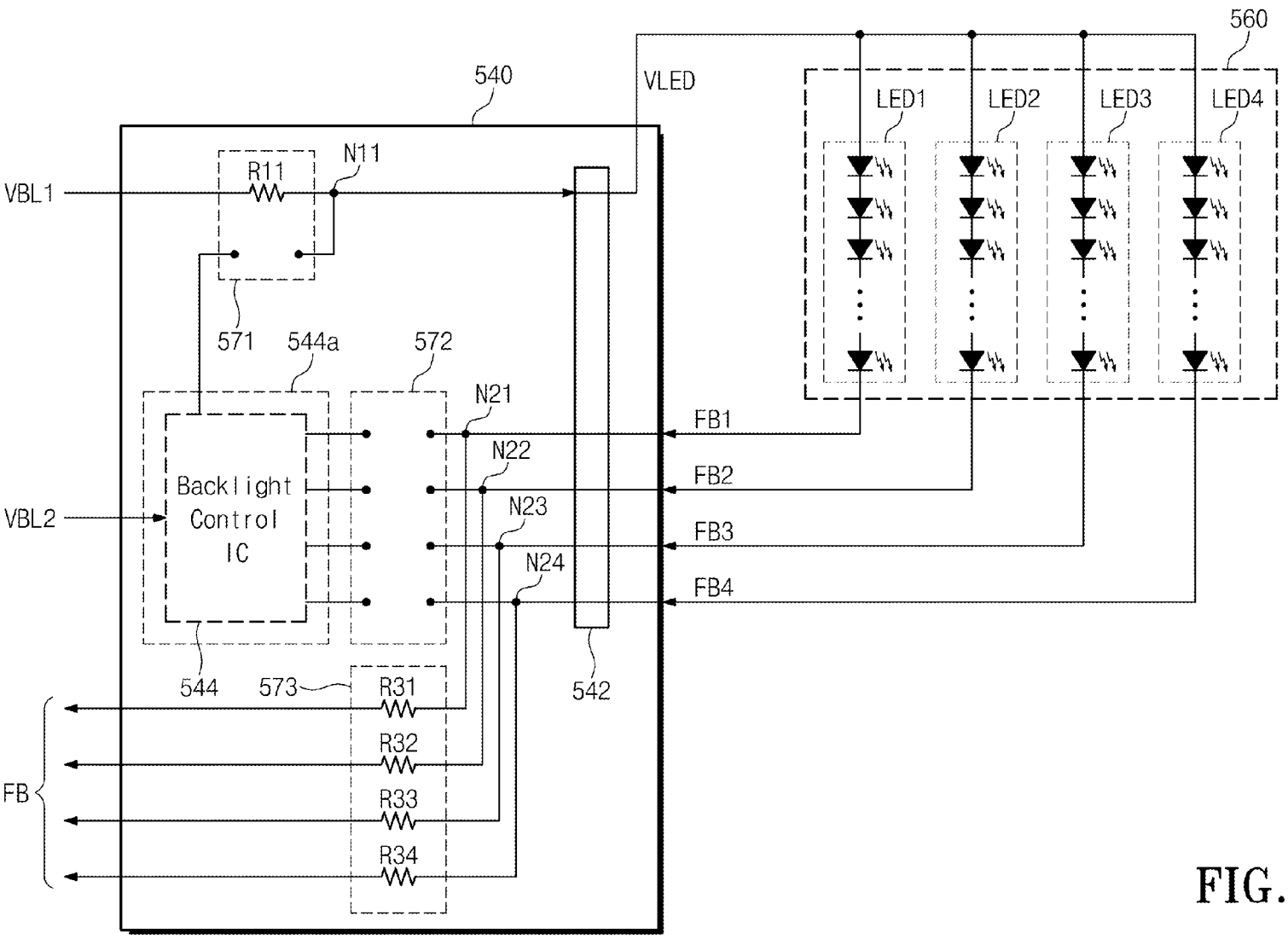
FIG. 9 is a circuit diagram showing a backlight control board and a backlight unit when a backlight control board shown in FIG. 8 is a first type backlight control board, according to an exemplary embodiment.

FIG. 9 is a circuit diagram showing the first type backlight control board 540 and the backlight unit 560 shown in FIG. 8, according to an exemplary embodiment. Referring to FIG. 9, the first type backlight control board 540 includes a connector 542, a first resistance part 571, a second resistance part 572, and a third option resistance part 573. A backlight control IC 544 is not disposed in an area 544*a* in the first type backlight control board 540. The first resistance part 571 of the first type backlight control board 540 includes a resistor R11 connected between the first source voltage VBL1 and a first node N11. Thus, the first source voltage VBL1 is applied to the backlight unit 560 as the third source voltage VBL3.

The backlight unit 560 includes LED strings LED1 to LED4. Each of the LED strings LED1 to LED4 includes LEDs connected to each other in series. An end of each of the LED strings LED1 to LED4 is connected to the third source voltage VLED from the backlight control board 540. The feedback signals FB1 to FB4 are respectively output from the other ends of the LED strings LED1 to LED4 and applied to the connector 542 of the backlight control board 540.

The second resistance part 572 of the first type backlight control board 540 does not include option resistors while the third resistance part 573 includes resistors R31 to R34. Each of the resistors R31 to R34 is connected between the connector 550 (shown in FIG. 8) and a corresponding node among nodes N21 to N24. Accordingly, the feedback signals FB1 to FB4 from the LED strings LED1 to LED4 are applied to the host device 50 shown in FIG. 8 through the resistors R31 to R34.

Figure 10:
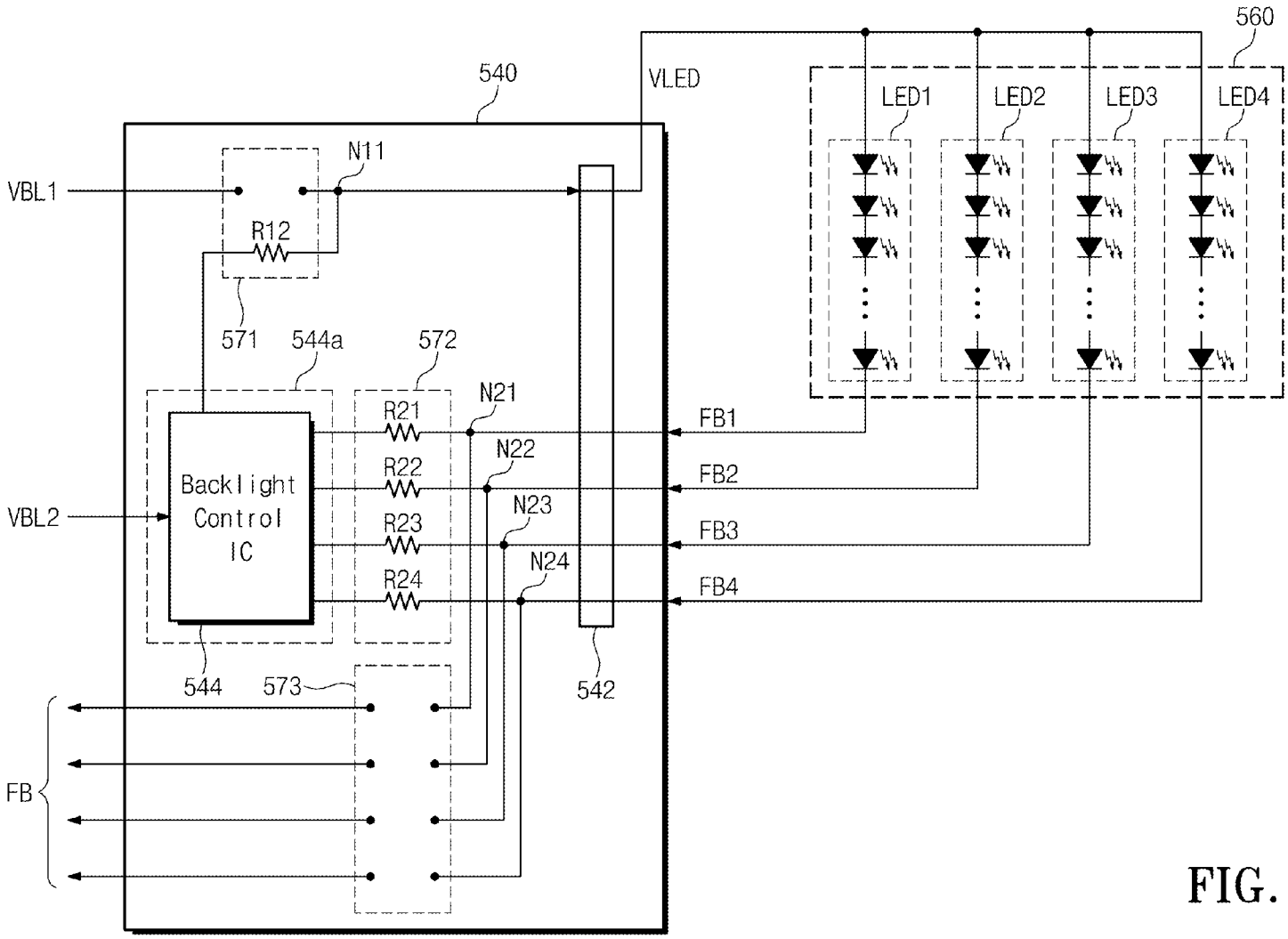
FIG. 10 is a circuit diagram showing a backlight control board and a backlight unit when a backlight control board shown in FIG. 8 is a second type backlight control board, according to an exemplary embodiment.

FIG. 10 is a circuit diagram showing the second type backlight control board and the backlight unit shown in FIG. 8, according to an exemplary embodiment. Referring to FIG. 10, a backlight control IC 544 is disposed in the area 544*a* of the second type backlight control board 540. The backlight control IC 544 receives the second source voltage VBL2 from the host device 50 and outputs the boosted third source voltage VLED.

The first resistance part 571 of the second type backlight control board 540 includes a resistor R12 connected between the backlight control IC 544 and the node N11. Therefore, the third source voltage VLED boosted by the backlight control IC 544 is applied to the backlight unit 560.

The second resistance part 572 of the second type backlight control board 540 includes resistors R21 to R24 while the third option resistance part 573 does not include option resistors. Each of the resistors R21 to R24 is connected between the backlight control IC 544 and a corresponding node among the nodes N21 to N24. Thus, the feedback signals FB1 to FB4 from the LED strings LED1 to LED4 are applied to the backlight control IC 544 through the resistors R21 to R24.

The backlight control IC 544 may sense the current level of the feedback signals FB1 to FB4 and control the voltage level of the third source voltage VLED in accordance with the sensed current level. In addition, the backlight control IC 544 may check the LED strings LED1 to LED4 for a malfunction and/or abnormal condition in response to the feedback signals FB1 to FB4. If a malfunction or abnormal condition is detected, the backlight control IC 544 may stop generating the third source voltage VLED that is output to the backlight unit 560.

As shown in FIGS. 9 and 10, because the resistors are selectively connected in the first, second, and third resistance parts 571, 572, and 573, the backlight control board 540 may be realized as a first type backlight control board or a second type backlight control board.

Although exemplary embodiments of the present system and method are described, it is understood that the present system and method are not limited to these exemplary embodiments. Instead, one of ordinary skill in the art would understand that various changes and modifications may be made without departing from the spirit and scope of the present system and method.

What is claimed is:

1. A display apparatus comprising:

a display panel configured to display an image;

a backlight circuit configured to supply a light to the display panel;

a host connector connected to a host;

a main control board configured to control the display panel to display an image in response to an image signal and a control signal that are provided by the host through the host connector; and a backlight control board separately provided from the main control board and configured to receive a source voltage from the host through the host connector to drive the backlight circuit, wherein the backlight control board applies the source voltage to the backlight circuit through a first plurality of line parts electrically connecting the host connector and the backlight control board and applies a feedback signal from the backlight circuit to the host through the first plurality of line parts and the connector.

2. The display apparatus of claim 1, further comprising a flexible printed circuit board that electrically connects the host connector to the main control board and the host connector to the backlight control board.

3. The display apparatus of claim 2, wherein the flexible printed circuit board comprises:

the first plurality of line parts; and a second plurality of line parts that electrically connects the host connector and the main control board.

4. The display apparatus of claim 3, wherein the source voltage includes a first source voltage and a second source voltage having a voltage level different from a voltage level of the first source voltage.

5. The display apparatus of claim 3, wherein the backlight control board drives the backlight circuit at the first source voltage.

6. A display apparatus comprising:

a display panel configured to display an image;

a backlight circuit configured to supply a light to the display panel;

a host connector connected to a host;

a main control board configured to control the display panel to display an image in response to an image signal and a control signal that are provided by the host through the host connector; and a backlight control board separately provided from the main control board and configured to receive a source voltage from the host through the host connector to drive the backlight circuit, wherein the source voltage includes a first source voltage and a second source voltage having a voltage level different from a voltage level of the first source voltage, and the backlight control board comprises a backlight control integrated circuit that receives the second source voltage, applies a third source voltage to the backlight circuit, and controls the third source voltage in response to a feedback signal from the backlight circuit.

7. The display apparatus of claim 6, wherein the backlight control board comprises:

a mounting area in which the backlight control integrated circuit is mounted;

a first circuit configured to apply the first source voltage or a boosted source voltage from the backlight control integrated circuit to the backlight circuit as a third source voltage;

a second circuit configured to apply the feedback signal from the backlight circuit to the backlight control integrated circuit; and a third circuit configured to apply the feedback signal from the backlight circuit to the host.

8. The display apparatus of claim 7, wherein the backlight control board is a first type backlight control board that receives the first source voltage from the host or a second type backlight control board that receives the second source voltage from the host.

9. The display apparatus of claim 8, wherein the backlight control board is the second type backlight control board and the backlight control integrated circuit is mounted on the mounting area of the second type backlight board.

10. The display apparatus of claim 9, wherein the backlight control integrated circuit receives the second source voltage from the host through the host connector and boosts the second source voltage to output the third source voltage.

11. The display apparatus of claim 9, wherein the first circuit in the second type backlight control board comprises at least one resistor to apply the third source voltage from the backlight control integrated circuit to the backlight circuit.

12. The display apparatus of claim 9, wherein the second circuit in the second type backlight control board comprises at least one resistor to apply the feedback signal from the backlight circuit to the backlight control integrated circuit.

13. The display apparatus of claim 8, wherein the backlight control board is the first type backlight control board and the first circuit in the first type backlight control board comprises at least one resistor to apply the first source voltage from the host to the backlight circuit as the third source voltage.

14. The display apparatus of claim 13, wherein the third circuit in the first type backlight control board comprises at least one resistor to apply the feedback signal from the backlight circuit to the host.

* * * * *